US008464898B2

(12) United States Patent
Giraud

(10) Patent No.: US 8,464,898 B2
(45) Date of Patent: Jun. 18, 2013

(54) MOISTURE-TIGHT EDIBLE FILM DISPENSER AND METHOD THEREOF

(75) Inventor: Jean-Pierre Giraud, Paris (FR)

(73) Assignee: CSP Technologies, Inc., Amsterdam, NY (US)

( * ) Notice: Subject to any disclaimer, the term of this patent is extended or adjusted under 35 U.S.C. 154(b) by 1479 days.

(21) Appl. No.: 10/595,776

(22) PCT Filed: Nov. 24, 2004

(86) PCT No.: PCT/US2004/039582

§ 371 (c)(1), (2), (4) Date: Apr. 20, 2009

(87) PCT Pub. No.: WO2005/051822

PCT Pub. Date: Jun. 9, 2005

(65) Prior Publication Data

US 2009/0200330 A1 Aug. 13, 2009

Related U.S. Application Data

(60) Provisional application No. 60/524,495, filed on Nov. 24, 2003, provisional application No. 60/533,362, filed on Dec. 29, 2003.

(51) Int. Cl.
*B65D 83/08* (2006.01)

(52) U.S. Cl.
USPC ..... 221/73; 221/37

(58) Field of Classification Search
USPC ..... 221/33, 36, 37, 40, 41, 208, 210, 221/220, 259–261, 268, 311
See application file for complete search history.

(56) References Cited

U.S. PATENT DOCUMENTS

| | | | | |
|---|---|---|---|---|
| 3,276,622 | A * | 10/1966 | Krzyzanowski | 221/37 |
| 3,986,479 | A * | 10/1976 | Bonk | 118/506 |
| 4,796,779 | A * | 1/1989 | Mamolou | 221/36 |
| 4,832,229 | A | 5/1989 | Hackmann et al. | |
| 5,197,630 | A * | 3/1993 | Kirla | 221/37 |
| 6,268,032 | B1 | 7/2001 | Mertens | |
| 6,299,018 | B1 | 10/2001 | Kimbrell | |
| 6,578,732 | B1 | 6/2003 | Mabry | |
| 7,428,978 | B2 * | 9/2008 | Lewis et al. | 221/39 |
| 7,661,555 | B1 * | 2/2010 | Evans et al. | 221/259 |
| 2003/0121932 | A1 * | 7/2003 | Wajda | 221/259 |
| 2009/0302048 | A1 * | 12/2009 | Nobilet et al. | 221/1 |
| 2011/0297695 | A1 * | 12/2011 | Schneider | 221/224 |

FOREIGN PATENT DOCUMENTS

DE 42 05 805 A1 9/1993

* cited by examiner

*Primary Examiner* — Gene Crawford
*Assistant Examiner* — Kelvin L Randall, Jr.
(74) *Attorney, Agent, or Firm* — Greenberg Traurig, LLP

(57) ABSTRACT

A film dispenser for dispensing individual strips of film comprising a main housing with an integrally attached hinged lid, wherein the housing and lid are one injection molded part that interfaces with a body and, when the closed, the lid creates a moisture tight seal with the main housing, the lid having a flexible arm attached to an underside of the lid, an opening in a topside of the main housing where a portion of the opening acts as a hinge point for the flexible arm, and, when the lid is opened, the arm assists in pushing or pulling the film out of the package; the body that is attached to the main housing to form a moisture tight seal with the main housing; and an indexing finger composed of an elastomer and attached to the underside of the hinged lid, the finger interacts with the flexible arm to dispense the individual strips.

1 Claim, 9 Drawing Sheets

MOISTURE-TIGHT EDIBLE FILM DISPENSER AND METHOD THEREOF

RELATED APPLICATIONS

This application is a national phase filing under 35 U.S.C. 371 of International Application No. PCT/US2004/039582 filed on Nov. 24, 2004, which claims the benefit of U.S. Patent Application No. 60/524,495 filed on Nov. 24, 2003 and U.S. Patent Application No. 60/533,362 filed on Dec. 29, 2003, the entirety of which are hereby incorporated by reference in their entirety for all purposes.

BACKGROUND OF THE INVENTION

Certain types of edible films are presently being used as a delivery system for mints and oral care products. Typically, the film is precut into rectangular pieces and packaged in a flat pack-shaped primary package. The edible film is stacked in the package. One problem that may be encountered with such a package is the difficulty of removing one piece of film from the stack. Another problem that may be encountered is the film pieces, at times, tend to curl during use life (when the film is exposed to moisture).

In another application, there is a belief that edible films can be used as a delivery system for ethical drugs. The edible film would comprise a carrier made of an edible film and a regulated amount of the desired drug. In one such application, the user would insert the edible film in their mouth and the edible film would dissolve-immediately dispensing the drug into the body. However, in this application, one desires to assure that a unit dose (a single piece of film) is delivered during use.

SUMMARY OF THE INVENTION

The present invention relates to an edible film dispenser that presents a single strip of film during each index cycle. In a further embodiment, the edible film dispenser provides a moisture tight environment during shelf life and during use life.

The film dispenser of the present invention is illustrated by showing two edible film dispenser designs: (1) a continuous film dispenser where a unit dose of film is cut during the index cycle and (2) a design that dispenses precut film pieces. However, it is understood that these designs are merely illustrative and are not meant to limit the scope of the present invention.

BRIEF DESCRIPTION OF THE DRAWINGS

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

FIG. 1A illustrates a flip-top main housing, FIG. 1B illustrates a tractor guide and FIG. 1C illustrates a drive assembly with drive roller and support roller.

FIG. 5A illustrates a side perspective of the dispenser and FIG. 5B illustrates the rotation of the continuous film dispenser.

FIG. 7B illustrates a side perspective of the dispenser and FIG. 7A illustrates the rotation of the continuous film dispenser.

FIGS. 9A and 9B illustrate, as the lid is raised, a flexible arm is pulled forward as it is prevented from moving upwards by the hinging point and FIG. 9C, illustrates, when the film dispenser is closed, the flexible arm is pushed through the "T" shaped opening and past the hinging point.

Figure 1A:
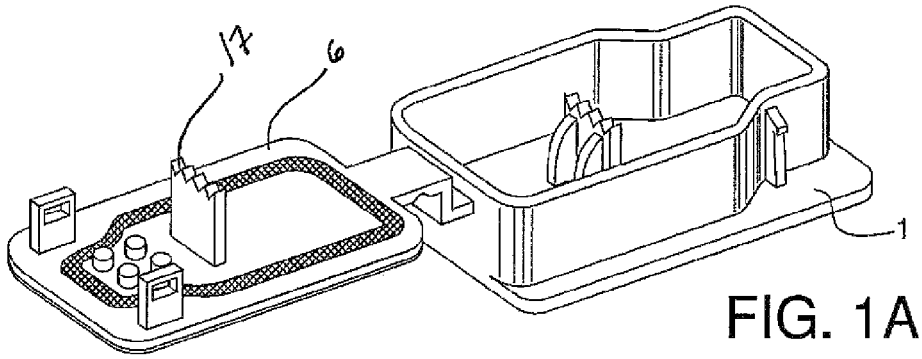
FIGS. 1A, 1B and 1C are perspective views of one embodiment of the present invention showing a continuous film dispenser where

The following reference characters are used in the specification and the figures:

1 flip top main housing
2 tractor guide
3 drive assembly
4 drive roller
5 support roller
6 lid
7 ramp
8 body
9 opening
10 first channel
11 second channel
12 second hinge point
13 flexible arm
14 indexing finger
15 sprockets
16 guide arms
17 knife-like feature
18 guide arm teeth
19 sprocket teeth
20 continuous bandoleer
21 supply side
22 drive shaft
23 thumb wheels
24 indexing slider
25 rack
26 pinion
27 half portion of lid
28 strips
29 first hinge point

DETAILED DESCRIPTION OF THE PRESENT INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

In one embodiment, the film dispenser of the present invention is illustrated by showing an edible film dispenser designs that dispenses precut film pieces. However, it is understood that this design is merely illustrative and are not meant to limit the scope of the present invention.

In one example, precut pieces of film are packaged in the dispenser (e.g. continuous bandoleer 20). For example, the bandoleer 20 is composed of 2-pieces of plastic film (e.g. PP, PET, etc) that is die cut and welded together to form pockets that each piece of film is placed. A set of regularly spaced tractor guide holes are placed in the bandoleer 20. These guide holes are used to precisely index the bandoleer 20 in the dispenser.

Figure 1B:
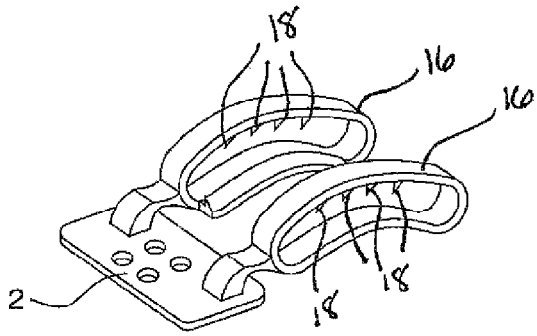
Figure 1C:
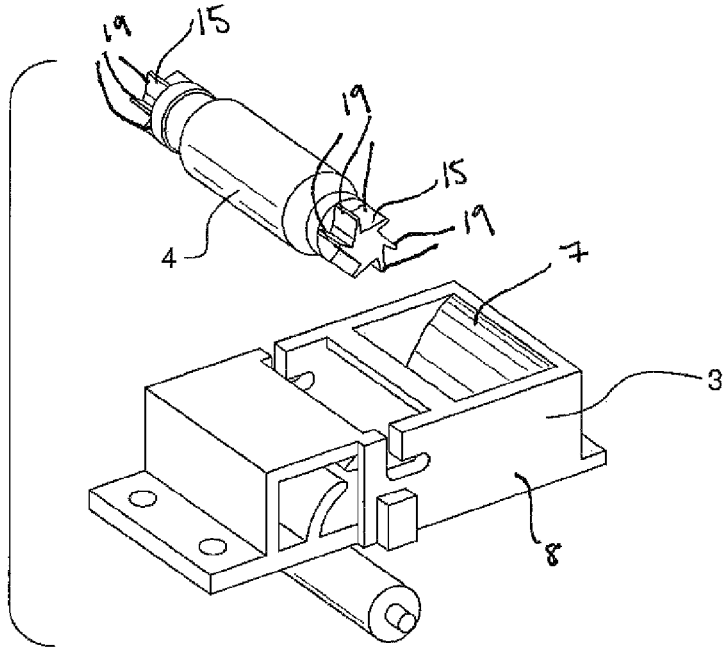

In one embodiment, the precut film dispenser is composed of the following components (see FIG. 1). The film pieces (not shown) are stacked directly on top of each other or separated by a release liner. By opening the Lid 6, an individual strip is indexed off the stack by a small elastomeric pad that pushes it towards a sloped ramp that guides the film piece up and out the dispenser so that it can be removed.

Figure 8:
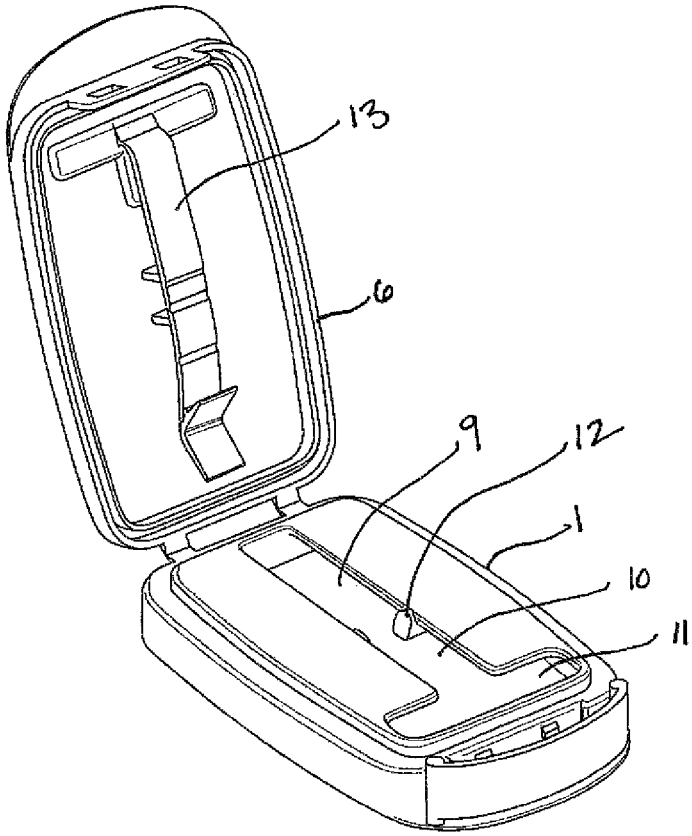
FIG. 8 is a perspective view of one embodiment of the present invention showing a pre-cut film dispenser.

In one embodiment, the precut film dispenser is composed of the following components (see e.g., FIG. 8):

1. Lid and Main Housing—an injection molded part that interfaces with the Body 8. This embodiment has a Main Housing 1 and a hinged Lid 6, which is attached to the main housing 1 about a first hinge point 29. When closed, the Lid 6 creates a moisture tight seal with the main housing 1. There is a "T" shaped opening 9, formed of a first channel 10 and a second channel 11, perpendicular to the first channel 10, in the Main Housing 1. In this opening 9 a feature acts as a second hinge point 12, which is separate and displaced from the first hinge point 29, for the Flexible Arm 13 as the Arm 13 slides underneath the hinge point 12. The Lid 6 and Main Housing 1 are bonded to the Body 8 in a manner that creates a moisture tight seal.

2. Body 8—An injection molded part that, for example, is made by two shot molding a material such as polypropylene and, at least a portion of, desiccant plastic. The desiccant plastic absorbs moisture that enters the package during the Shelf Life and Use Life. In one example, the desiccant plastic holds the film pieces and is shaped in the form of a ramp 7 or slope so that the film strip 28 is forced up and out of the package when being indexed. In a further embodiment, a Child Resistant (CR) feature is incorporated into this component as well. By pressing in on CR feature, the Lid can be opened which will cause the film to be dispensed.

3. Indexing Finger 14—An injection molded part that is made, for example, by two shot molding an elastomer and a material such as polypropylene. The Indexing finger 14 is bonded to the hinged Lid 6 during the assembly process. The end of the Indexing Finger 14 that is not bonded to the Lid 6 is made of elastomer and when closed is in contact with the film strip. It fits through the "T" shaped opening 9 in the Main Housing 1.

In one example of the operation of the present invention, the package is sealed when it is closed. The Lid 6 seals to the Main Housing 1 (e.g. by snapping over a sealing feature). The result is a moisture tight seal. The desiccant plastic absorbs moisture that may come into the package, from the opening and closing of the Dispenser, or that penetrates through the materials. In one example, the absorbing material is used because the Film Strips themselves contain moisture, which may be driven off by changes in temperature that the package goes through. Thus the present invention maintains the Film Strips in a dry environment throughout the Shelf Life and the Use Life.

Figure 9A:
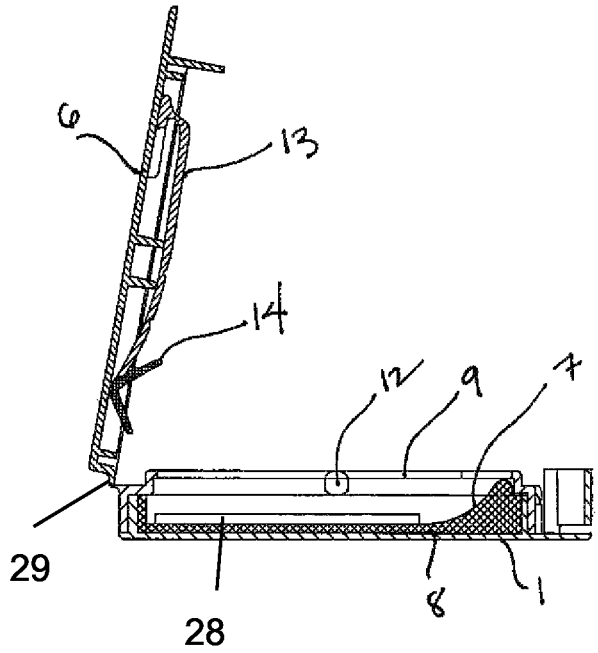
FIGS. 9A, 9B and 9C are side perspective views of one embodiment of the present invention showing a pre-cut film dispenser where
Figure 9B:
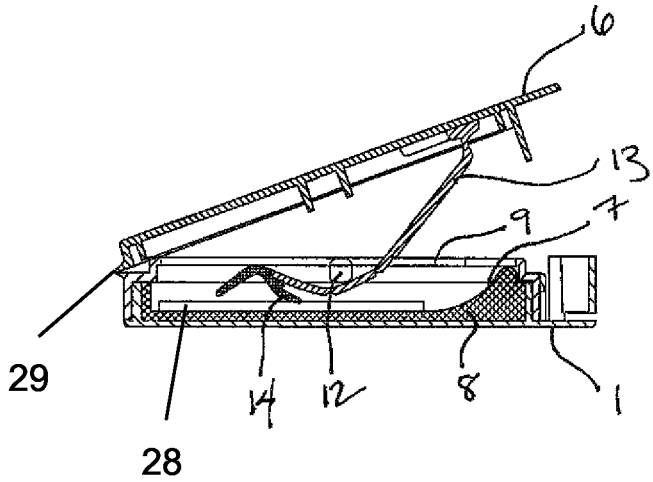

When the Lid is opened, an Arm 13, which is attached to the Lid 6, pushes or pulls the film strip off the stack and out of the package (see FIG. 9B). When the Lid 6 is closed, the Arm 13 returns to a home position, ready for the next dispense cycle (see FIG. 9C).

Figure 9C:
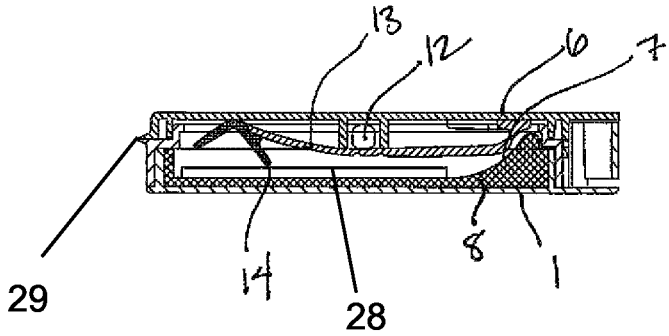

The following is an illustration of the present invention (as shown in FIGS. 9A through 9C). In FIG. 9C, when the film dispenser is closed, the Flexible Arm 13 is pushed through the "T" shaped opening 9 and past the hinging point 12. In FIG. 9A, as the Lid 6 is raised, the Flexible Arm 13 is pulled forward as it is prevented from moving upwards by the hinging point 12. The Flexible Arm 13 rides in the first channel 10 of the opening 9. Since the elastomeric portion of the Flexible Arm 13 is in contact. with the Film Strip, the top Film Strip on the stack is pulled forward with the Flexible Arm 13. As it encounters the ramp 7, it is redirected upwards and through the "T" shaped opening 9 so it is accessible.

The Flexible Arm 13 is returned to the home position, ready to index the next strip, by pushing the Lid 6 back down sealing it to the Main Housing 1. Alternatively, the user could continue to open the package so the Flexible Arm 13 clears the Hinging Point 12, which allows it to come out of the opening, as shown in FIG. 9A. The package is closed, which pushes the Flexible Arm 13 back through the opening and under the hinging point 12 ready for the next index.

In one embodiment, the continuous film dispenser is composed of the following components (see FIGS. 1A, 1B and 1C):

1. Flip-Top Main Housing 1—an injection molded part (e.g. made via 2-shot molding of <BR> polypropylene and a thermoplastic elastomer (TPE) i.e., Santoprene). In one embodiment, the Santoprene forms a moisture tight reusable seal.
2. Tractor Guide 2—an injection molded part (e.g. made of polypropylene) that has a base with, for example, 2-caterpillar tractor guides attached. The tractor guide is assembled to the lid of the main housing via posts in the main housing lid. In one example, the assembly may be accomplished by ultrasonic welding.
3. Drive Assembly (Magazine) 3—(e.g. can be made of polypropylene or 3-phase desiccant plastic). In one example, the drive roller 4 and support roller 5 are assembled into the drive assembly 3, via a snap fit. The drive assembly 3 also holds a supply of edible film in a single, continuous arrangement. In one example, the drive assembly 3 is placed into the main housing 1 and assembled via spot welding using a heat source or ultrasonic welding.
4. Drive Roller 4—(e.g. can be made via 2-shot molding-polypropylene inner shaft and drive sprockets with a TPE (Santoprene) coating the inner shaft). In one embodiment, the TPE serves as the edible film contact surface. For example, the sprockets 15 of the drive roller 4 are assembled into the guide arms 16.
5. Support Roller 5—(e.g. can be made via 2-shot molding-polypropylene inner shaft with a TPE (Santoprene) coating the inner shaft). For example, the TPE serves as the edible film contact surface.

Figure 2:
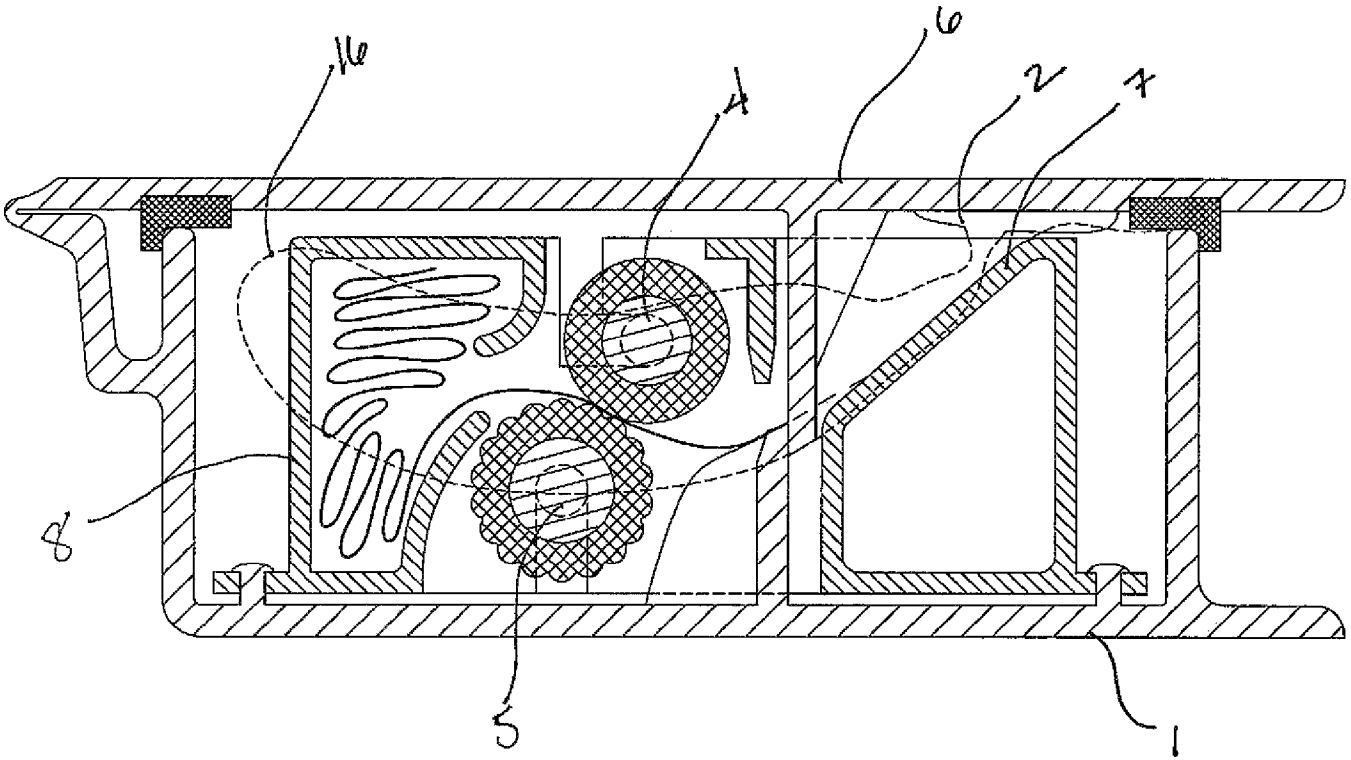
FIG. 2 is a side perspective view of one embodiment of the present invention showing a method of feeding the continuous film.

In one embodiment, the continuous film dispenser holds a supply of film to support 50-100 dispense cycles. FIG. 2 is an example of one embodiment of the method of feeding the continuous film. In that example, the edible film supply is not rolled; rather the film is folded into the drive assembly, similar to an impact printer cartridge ribbon. The continuous piece of edible film is fed between the drive roller 4 and the support roller 5.

Figure 3:
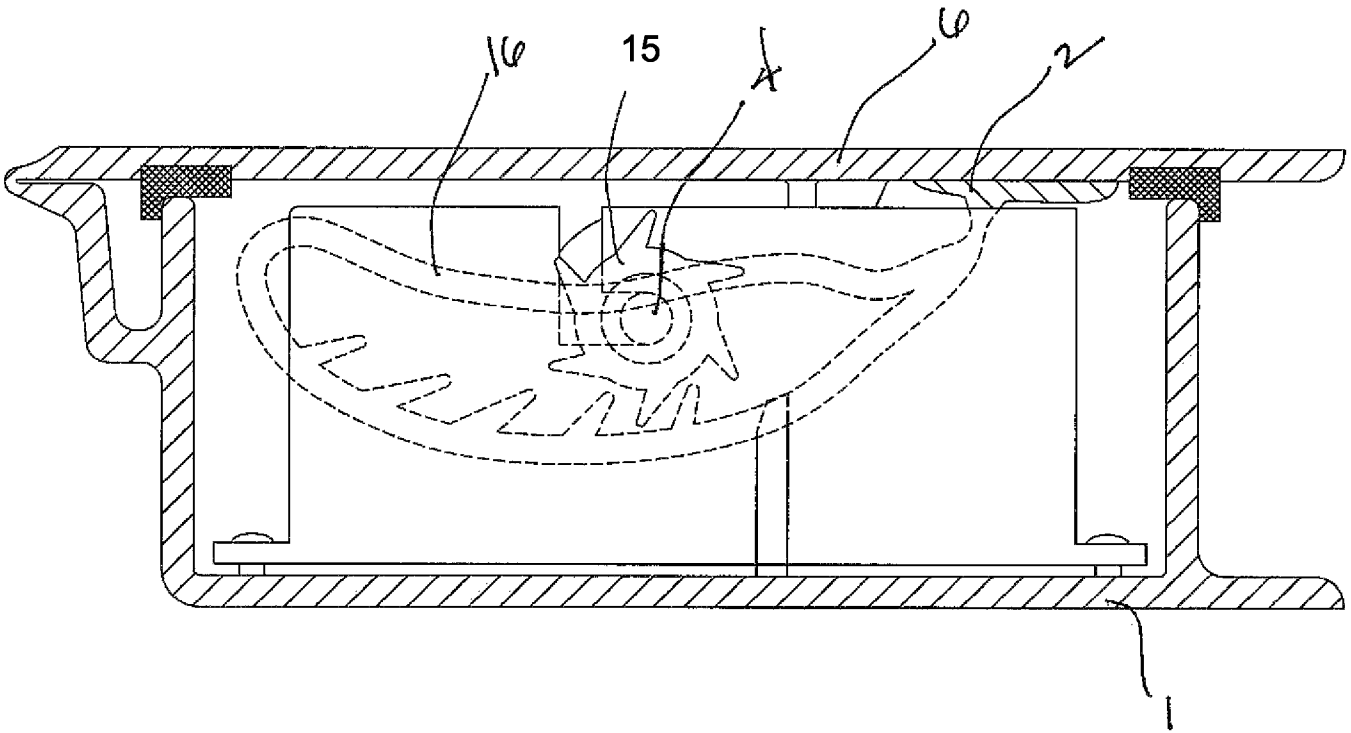
FIG. 3 is a side perspective view of one embodiment of the present invention showing an operation of the drive mechanism.
Figure 4:
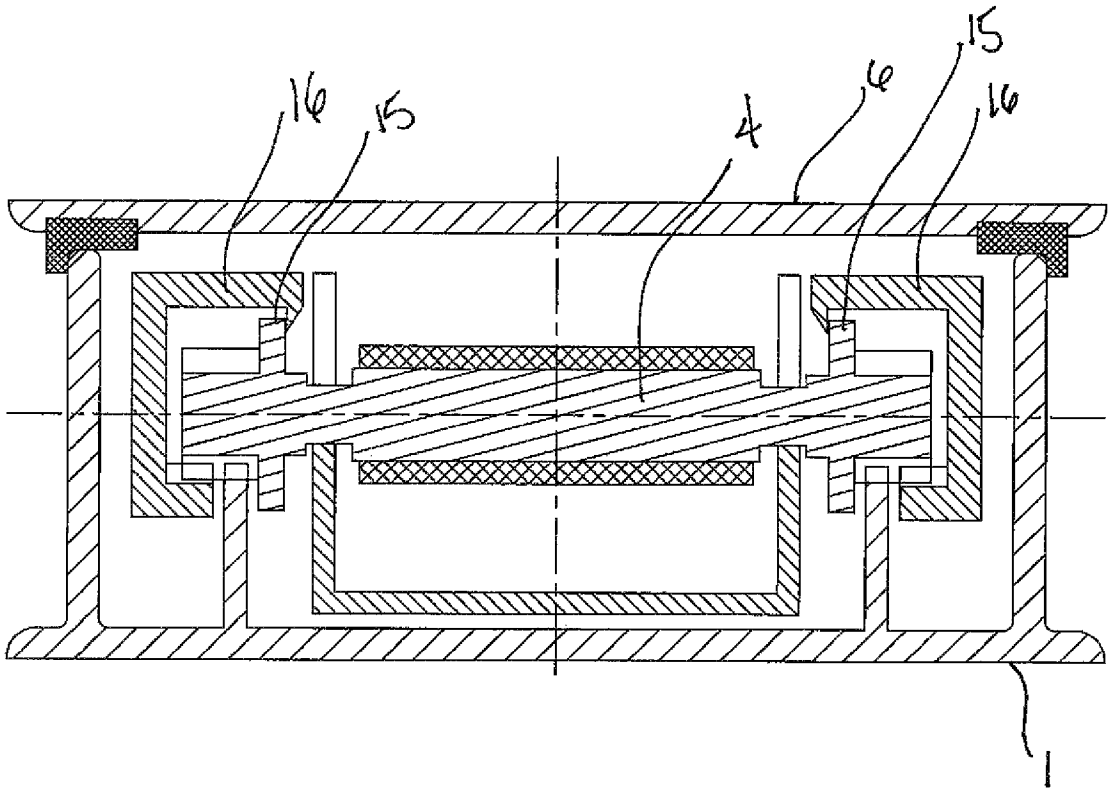
FIG. 4 is a side perspective view of one embodiment of the present invention showing an indexing of the film from the dispenser.

In this example, the edible film is dispensed while the lid 6 is opened by a user. When the lid 6 is opened, the tractor guide 2, which is attached to the lid 6, also rotates upward. During this motion, the drive roller sprockets 15 rotate as the guide arms 16 are displaced by the lid 6 motion (see FIG. 3). The edible film is positioned between the drive roller 4 and support roller 5. As the drive roller 4 rotates, the edible film is indexed out of the dispenser (see FIG. 4).

When the lid 6 is closed, the film is cut, via a knife-like feature 17 on the underside of the flip-top lid 6 in the main housing 1 (see FIG. 1). The lid 6 snaps closed and the moisture-tight seal is reestablished. In one embodiment, the moisture tight seal maintains a moisture ingress below about 300 micro-g/day.

In a further embodiment, during lid 6 closing, the guide arms 16 return to the home position. The guide arms 16 comprise teeth 18 that ride over the drive roller sprockets 15. The drive roller 4 only rotates in 1-direction—the sprocket teeth 19 do not engage the guide arms 16 and cause the sprockets 15 to rotate during lid 6 closing.

In yet another embodiment, a 'brake feature' is included to prevent a user from pulling an excessive amount of film out of the dispenser before cutting. In another example, the features of the lid 6 are designed so that it must be opened some minimum amount to ensure that a full dose of film is indexed out of the dispenser.

In an example of an embodiment relating to precut film strips, precut pieces of film are packaged in the dispenser (e.g. continuous bandoleer 20). For example, the bandoleer 20 is composed of 2-pieces of plastic film (e.g. PP, PET, etc) that is die cut and welded together to form pockets that each piece of film is placed. A set of regularly spaced tractor guide holes are placed in the bandoleer 20. These guide holes are used to precisely index the bandoleer 20 in the dispenser.

In one embodiment, the continuous film dispenser is composed of the following components (see FIG. 5):

1. Flip-Top Main Housing 1—an injection molded part (e.g. made via 2-shot molding of <BR> polypropylene and a thermoplastic elastomer (TPE) i.e., Santoprene). In one example, the Santoprene forms a moisture tight reusable seal. There are a set of through holes in the side walls of the main housing. These holes each have TPE gaskets—the drive shaft & amp; thumb wheel are assembled through these holes.
2. Film Indexing Drive Assembly 3—(e.g. can be made of polypropylene or 3-phase desiccant plastic). The drive sprocket 15 is assembled into the drive assembly (e.g. via a snap fit). The drive assembly has 2-compartments that hold the continuous bandoleer 20. One compartment is the supply side 21 (bandoleer filled with edible film pieces) and a take-up compartment 22 (empty bandoleer). The drive assembly 3 is placed into the main housing 1 (e.g. assembled via spot welding using a heat source or ultrasonic welding).
3. Drive Sprocket 15—(e.g. made of polypropylene). The drive sprockets 15 are driven by an external thumb wheel. As the drive sprocket 15 is rotated, the bandoleer 20 is indexed forward. The sprocket moves in 1-direction.
4. Thumb Wheel & Drive Shaft—(e.g. made of polypropylene). The sprockets 15 are assembled onto the drive shaft 22. The drive shaft 22 is fitted into the main housing 1, through the film indexing drive assembly. A set of thumb wheels 23 are attached to the ends of the drive shaft 22.

FIGS. 5, 6, 6*a* and 7 illustrate different methods (although not limited to these methods) by which the sprocket 15 may be powered to index the bandoleer 20 forward. In all cases, individual pieces of film are packaged into a bandoleer 20. The dispenser has supply and take-up compartments. The bandoleer is a disposable component. However, it is understood that these designs are merely illustrative and are not meant to limit the scope of the present invention.

Figure 5A:
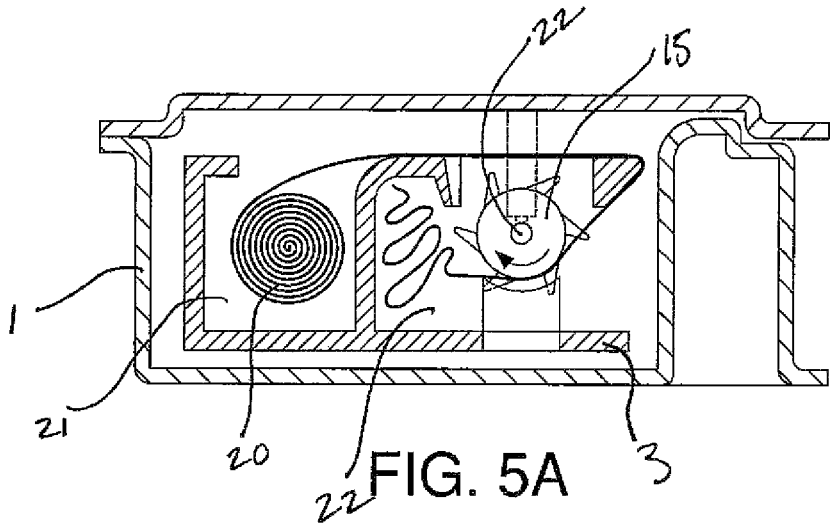
FIGS. 5A and 5B are perspective views of one embodiment of the present invention showing a continuous film dispenser where
Figure 5B:
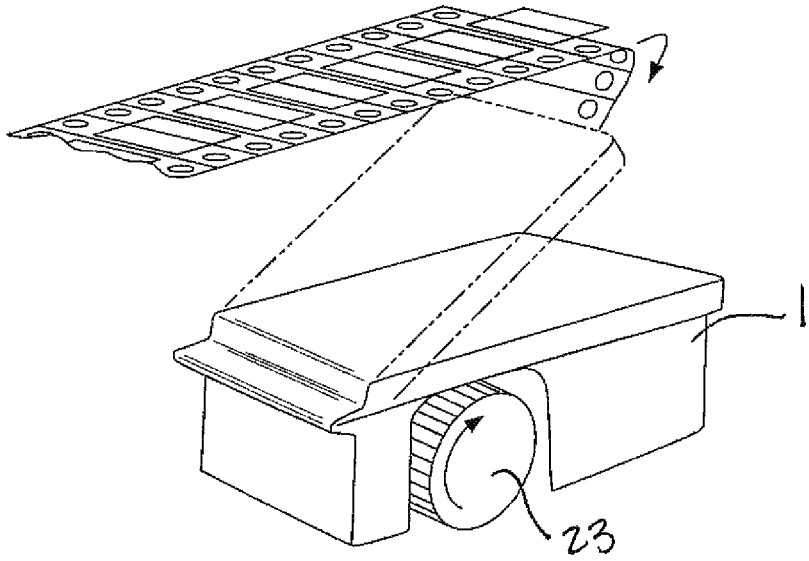

Embodiment in FIG. 5

1. Open Flip-top lid.
2. Rotate thumb wheel to index a piece of film.
3. Remove film.
4. Close lid.

Figure 6:
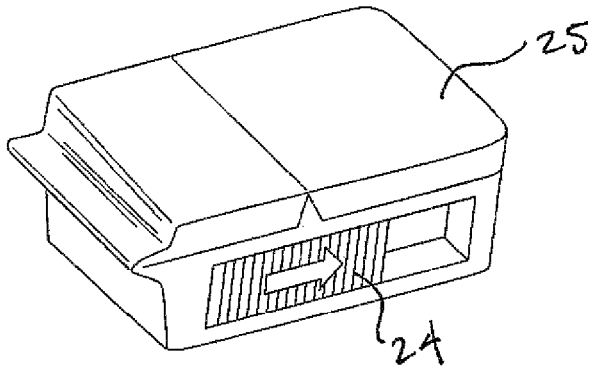
FIGS. 6 and 6A are perspective views of different embodiments of the present invention showing a continuous film dispenser with different methods by which a sprocket may be powered to index the bandoleer forward and thus dispense the strips.

Embodiment in FIG. 6

1. Open Flip-top lid.
2. Pusher indexing slider 24 forward to index a piece of film.
3. Remove film.
4. Close lid.

Figure 6A:
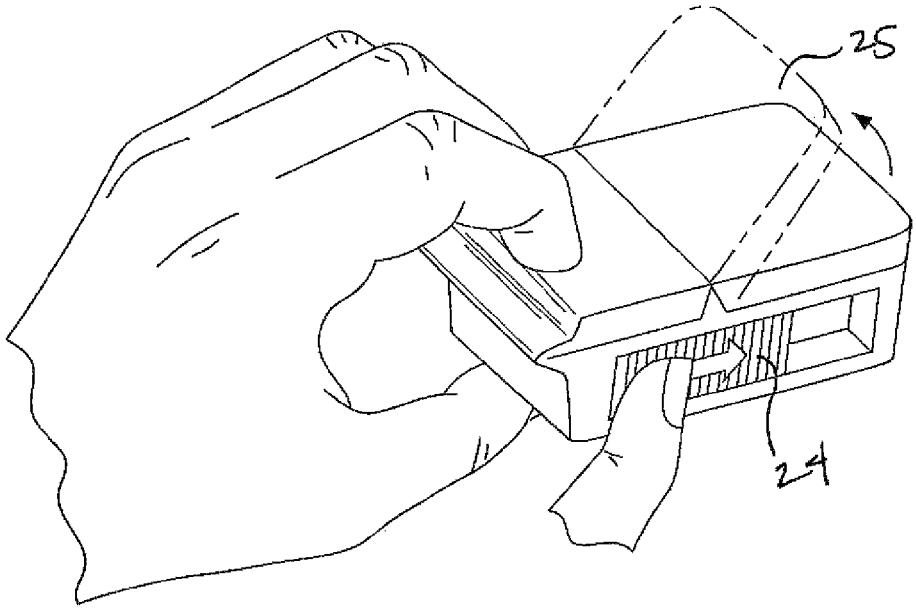

Embodiment in FIG. 6*a* (Double Action Flip-Top Lid)

1. Open half portion of the Flip-top lid.
2. Pusher indexing slider forward to index a piece of film.
3. Remove film.
4. Close half portion 27 of the lid.

Figure 7A:
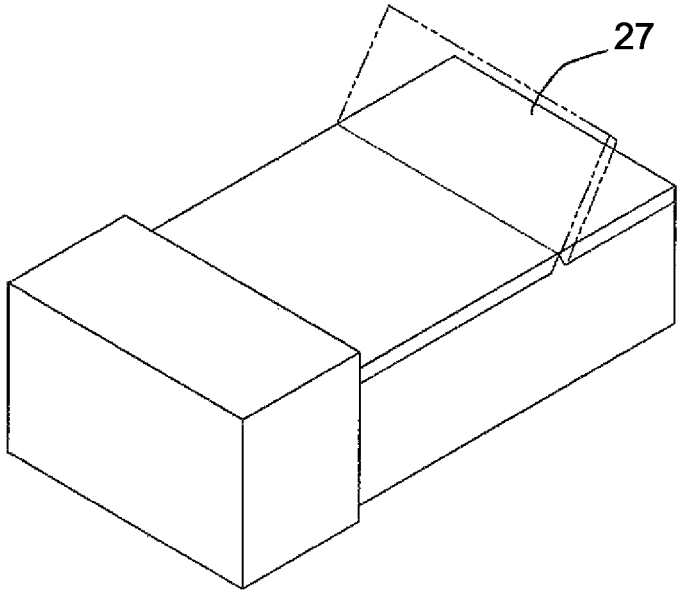
FIGS. 7A and 7B are perspective views of one embodiment of the present invention showing a continuous film dispenser where
Figure 7B:
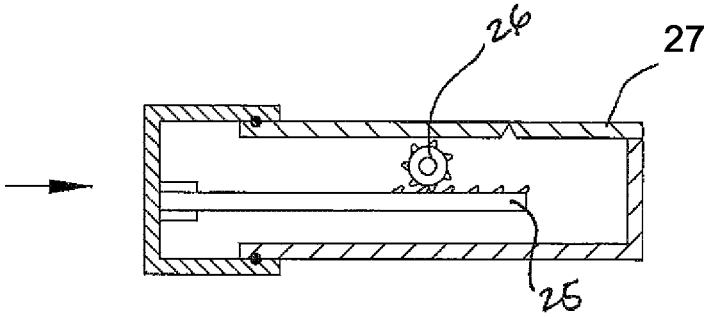

Embodiment in FIG. 7

1. Open half portion 25 of the Flip-top lid.
2. Squeeze the dispenser together to index a piece of film (dispenser uses a rack and pinion design to index the bandoleer).
3. Remove film.
4. Close half portion of the lid.

In yet another embodiment, the present invention may also include a dispenser that is either disposable or reusable. For example, the entire dispenser is discarded after one emptying out the edible film. In the reusable case, in one example, the spent bandoleer is disposable so that a new bandoleer filled with film piece may be reloaded into the re-usable dispenser. In another embodiment, part of the dispenser may be made of a desiccant plastic such as, but not limited to, disclosed in U.S. Pat. Nos. 5,911,937 and 6,214,255, which are incorporated by reference herein. For example, the film indexing drive assembly may be made of a desiccant plastic. In another example, the dispenser may hold a desired quantity of edible film-such as 25, 50, 75, or 100 units.

In one embodiment, the dispenser of the present invention is designed to maintain a moisture tight seal during shelf and use life of less than about 300 micro-g/day. For purposes of the present invention, in another embodiment, the dispenser of the present invention is "moisture tight" in accordance with the test protocols set forth in United States Pharmacopeia (USP) 671. In one embodiment, the dispenser is considered "moisture tight" where not more than one of the, 10 test dispenser exceeds 100 mg per day, per liter, in moisture permeability. Testing for USP 671 is conducted on sealed containers and on containers that have been opened and then resealed. The testing consists of a desiccant of set quantity 4-8 mesh, anhydrous calcium chloride being first dried at 110 degrees for one hour then cooled in a desiccator. Then 12 containers of uniform size are selected and opened and closed 30 times each. Torque is applied to the closures as specified in the USP monograph. Desiccant is then added to 10 of the packages labeled test containers. These are then filled to within 13 mm of the opening on containers larger than 20 ml and to two-thirds full on containers smaller than 20 ml. The closures are then applied to the torque specified in the monograph. Weight is recorded to the' nearest 0.1 mg for containers smaller than 20 ml, to the nearest mg for 20 ml to 200 ml, or to the nearest centigram if the container is larger than 200 ml. The containers are stored at 75 percent, plus or minus three percent, relative humidity at a temperature of 23 degrees, plus or minus two degrees. After 36 hours, plus or minus one hour, the weight is recorded, with the moisture permeability calculated in mg per day, per liter.

The following is an illustrative example that tests breath strips in the dispensers of the present invention compared with a non-desiccated breath strip pack at 25 C 80% RH to determine the effectiveness of these packs in protecting the strips during use life. Watson Spearmint Breath strips, Wrigley's Spearmint Breath strips and strips from Pfizer were tested at 25 C 80% Rh to determine the variation in strip chemistry stability for this use life condition in their own primary packaging.

Test 1 (Current Dispenser)

1. Tested five replicates of breath strips for each variable or pull.

2. 24-Watson Strips each (in current dispenser) were placed into a chamber at 25 C/80% Rh and physical descriptions were taken for each strip set prior to the test.

3. Looked at samples every 24 hours to look for changes in appearance. Pulled samples from chamber when samples began to block or stick together.

Test 2 (Present Invention)

1. Tested five replicates of breath strips for each variable or pull.

2. 24-Watson Strips each (in Desiccated CSP pocket pack) placed into a chamber at 25 C/80% Rh and physical descriptions were taken for each strip set prior to the test.

3. Looked at samples every 24 hours to look for changes in appearance. Pulled samples from chamber when samples began to block or stick together.

Results:

Test 1

1. All Watson strips were blocking in all dispensers within 24 hours. There was no color change seen in any of the strips.

Test 2

1. No blocking after 21-days. Approx, 1/3 desiccant capacity used, but rate of desiccant absorption rate is slower than ingress into the package after 21-days. All Watson strips were blocking in all dispensers after 22 days. There was no color change seen in any of the strips.

Whereas particular embodiments of the present invention have been described above as examples, it will be appreciated that variations of the details may be made without. departing from the scope of the invention. One skilled in the art will appreciate that the present invention can be practiced by other than the disclosed embodiments, all of which are presented in this description for purposes of illustration and not of limitation. It is noted that equivalents of the particular embodiments discussed in this description may practice the invention as well. Therefore, reference should be made to the appended claims rather than the foregoing discussion of examples when assessing the scope of the invention in which exclusive rights are claimed.

What is claimed is:

1. A method of indexing individual strips of film comprising the steps of: closing a lid of a film dispenser that results in pushing a flexible arm, which is located on an underside of the lid, through a "T" shaped opening in a housing and past a hinging point in the opening; raising the lid that results in the flexible arm being pulled forward as the arm is prevented from moving upwards by the hinging point and, as such, the flexible arm rides in a channel of the "T" shaped opening; and contacting the film strip with the arm so that an individual film strip, which is on top of a stack of film strips in the housing, is dispensed with the flexible arm.

* * * * *